US006126027A

United States Patent [19]

Thompson

[11] Patent Number: 6,126,027

[45] **Date of Patent: *Oct. 3, 2000**

[54] SELF-CENTERING CONTAINER CLOSURE

[75] Inventor: Nigel Thompson, West Midlands, United Kingdom

[73] Assignee: MCG Closures Limited, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/915,940

[22] Filed: Aug. 21, 1997

Related U.S. Application Data

[63] Continuation of application No. PCT/GB96/00346, Feb. 14, 1996.

[30] Foreign Application Priority Data

| | | | |
|---|---|---|---|
| Feb. 21, 1995 | [GB] | United Kingdom | 9503430 |
| Aug. 9, 1995 | [GB] | United Kingdom | 9516347 |

[51] Int. Cl.[7] ..... B65D 41/34; B65D 41/00

[52] U.S. Cl. ..... 215/354; 215/252; 215/344; 215/320

[58] Field of Search ..... 215/252, 341–345, 215/DIG. 1, 901, DIG. 3, DIG. 8, 320, 354

[56] References Cited

U.S. PATENT DOCUMENTS

| | | | |
|---|---|---|---|
| 3,067,900 | 12/1962 | Kessler . | |
| 3,074,579 | 1/1963 | Miller | 215/DIG. 1 X |
| 3,151,757 | 10/1964 | Martin | 215/DIG. 1 X |
| 3,255,907 | 6/1966 | Eddy | 215/DIG. 1 X |
| 3,255,909 | 6/1966 | Miller et al. | 215/344 X |
| 3,480,169 | 11/1969 | Hammes | 215/354 X |
| 3,489,306 | 1/1970 | Bubb | 215/DIG. 8 X |
| 4,072,244 | 2/1978 | Mueller | 215/DIG. 1 X |
| 4,220,250 | 9/1980 | Brownbill | 215/344 X |
| 4,301,937 | 11/1981 | Von Hagel | 215/252 |
| 4,379,512 | 4/1983 | Ohmi et al. | 215/343 X |
| 4,442,947 | 4/1984 | Banich, Sr. | 215/DIG. 1 X |
| 4,489,845 | 12/1984 | Aichinger et al. | 215/341 X |
| 4,526,284 | 7/1985 | Herbert | 215/DIG. 1 X |
| 4,566,603 | 1/1986 | Moore | 215/344 X |
| 4,570,811 | 2/1986 | Lecinski et al. | 215/343 |
| 4,623,070 | 11/1986 | Nishikawa | 215/DIG. 1 X |
| 4,638,917 | 1/1987 | Persch | 215/252 |
| 4,667,838 | 5/1987 | Yeager | 215/252 |
| 4,732,289 | 3/1988 | Granat et al. | 215/252 |
| 4,739,893 | 4/1988 | Zumbuhl | 215/344 |
| 4,830,207 | 5/1989 | Battegazzore | 215/252 |
| 5,161,707 | 11/1992 | Dutt et al. | 215/344 |
| 5,421,470 | 6/1995 | Dudzik | 215/343 X |
| 5,489,036 | 2/1996 | Arkins | 215/DIG. 1 X |
| 5,609,263 | 3/1997 | Perchepied | 215/252 |
| 5,730,309 | 3/1998 | Jiradejnunt et al. | 215/354 X |

FOREIGN PATENT DOCUMENTS

| | | | |
|---|---|---|---|
| 293901 | 7/1988 | European Pat. Off. . | |
| 316167 | 5/1989 | European Pat. Off. . | |
| 575987 | 12/1993 | European Pat. Off. . | |
| 542509 | 11/1955 | France | 215/354 |
| 2327930 | 5/1977 | France . | |
| 4135109 | 4/1993 | Germany . | |
| 9314226 | 1/1995 | Germany . | |
| 2046720 | 11/1980 | United Kingdom . | |

*Primary Examiner*—Gregory M. Vidovich
*Attorney, Agent, or Firm*—Laubscher & Laubscher

[57] ABSTRACT

A self-centering container closure includes a locator annulus which extends downwardly from the undersurface of the crown, radially inwardly from a resilient fin. The annulus extends downwardly by a distance greater than the fin and has an outer diameter slightly smaller than that of the inner diameter of the neck of the container with which it is to be used. The annulus assists with centering the closure on the container as the closure is screwed onto the container.

10 Claims, 2 Drawing Sheets

SELF-CENTERING CONTAINER CLOSURE

This application is a continuation of PCT application No. PCT/GB 96/00346 filed Feb. 14, 1996.

BACKGROUND OF THE INVENTION

The present invention relates to a self-centering container closure particularly of the type adapted for utilisation with a gaseous liquid.

BRIEF DESCRIPTION OF THE PRIOR ART

Container closures molded in one piece from a plastic material are well known in the art. One such is disclosed in our earlier European Patent No. 0136088 which relates to a container closure molded in one piece from a plastic material and comprising a top (or crown), a dependent skirt, the radially inner surface of which is formed with a screw thread, a surface which is flared in a direction away from the top being formed on the internal surface of the skirt where it joins the top, and an annular resilient flexible fin extending downwardly and outwardly from the underside of the top at a position spaced regularly inwardly in the flared surface and having a length such as to permit at least its portion adjoining its free edge to lie against the flared surface when the fin is deformed outwardly by the rim of the neck of a container to which the closure is to be applied.

Whereas closures of this type work satisfactorily, there remains the problem of centering the cap on the container in a really reliable way and of preventing "cocking" which occurs during capping. During capping it is difficult to ensure that the plane of the crown becomes perpendicular to the axis of the container neck prior to rotation. This is not always possible during high speed capping and accordingly a problem arises when the caps are screwed rapidly onto the container necks. Whereas a certain tolerance in the screw-thread portions can allow a degree of "cocking" to be corrected during capping, it is relatively easy to destroy the closures during the capping procedure due to this defect.

Container closures including downwardly depending internal bore seals are also known in the art. The purpose of these arrangements is to enable a cap to be rapidly screwed onto a container neck such that the rim of a container neck seals against the underside of the crown, whereas the internal bore of the container neck is in sealing contact with the bore seal annulus.

In a full bottle of a carbonated beverage as the temperature rises, gas tends to come out of solution and to increase the gas pressure in the container. This tends to force the underside of the crown of the container closure upwardly thereby overcoming the lateral pressure exerted on the inner face of the prior art bore seals and thereby allows a fluid path to open up between the outer face of the bore seal and the inner face of the container neck towards the rim. Simultaneously a doming effect impairs the seal between the underside of the crown and the rim of the container neck. Accordingly gaseous escape paths are generated and gas escapes from the container. The consumer can therefore be left with "flat" contents. This effect is accentuated if scratches are present on the rim of the container neck because these also tend to allow gas to escape. This is an especial problem with recycled containers.

SUMMARY OF THE INVENTION

The present invention has as its object the alleviation of these problems by providing closures of the foregoing general type provided with means for self-centering during capping and means for alleviating the problem of cocking.

In a further aspect of the present invention, the invention also provides means for reducing the incidence of doming. The arrangement of the invention can also reduce the possibility of successful tampering because the closure is retained substantially coaxial in the container neck.

The invention is characterized by a continuous or discontinuous locator annulus depending downwardly from the under surface of the crown and disposed radially inwardly of the fin annulus, the locator annulus extending downwardly by a distance greater than that of the fin and having an outer diameter just smaller than the inner diameter of the container neck with which it is to be used. The distance may be up to 100% longer than the corresponding distance from the underside of the crown to the fin.

The fin may be bulbous at its remote end and may be provided with a neck contact surface inclined inwardly and upwardly towards the crown for contact in use with the outer rim of the container neck. Preferably the central point of an articulation portion of the fin is located along a line parallel to the axis of the closure and within the outer one half of the diameter of the container neck with which the closure is to be used. In a preferred embodiment, the central point of the articulation portion is within the outer one third or even one quarter of the diameter of the container neck.

The articulation portion may have a radial thickness greater than one quarter of the radial thickness of the bulbous fin. This means that when the closure has been centered on the neck by operation of the locator annulas, the inclined surface of the bulbous fin contacts the outer rim of the container neck and, since the closure is rotating and since the bulbous fin is a relatively strong annulus, the inclined surface thereof tends to further ensure centering of the closure prior to and during deformation. By this means, "cocking" is alleviated since contact under rotation tends to locate the closure in its correct orientation perpendicular to the axis of the closure.

The angle of the inclined plane of the bulbous fin is preferably between about 35° and 55° and most preferably about 45° relative to the axis of the container closure.

The remote end of the locator annulus may be chamfered or the radially outer remote end thereof may be inwardly and downwardly inclined so as to present an outwardly and upwardly inclined surface to the inner rim of the container neck. Preferably the upper end of the inclined plane of the locator annulus terminates at or adjacent a notional plane horizontal to the axis of the closure which is also generally coincident with the lower end of the inclined contact surface of the bulbous fin. Thus, the two mutually opposed inclined planes respectively of the bulbous fin and the locator annulus operate sequentially upon a container rim. The angle of the inclined plane of the locator annulus is preferably 25° to 35° relative to the axis of the container closure.

It will also be appreciated that the positioning of the locator annulus radially inwardly of the fin has the effect of strengthening the crown against "doming". Thus, a combination of the fin (preferably bulbous) and the locator annulus is particularly effective in resisting doming and its effects on the seal achievable by the fin outboard thereof. The closures of this type are most preferably made by injection molding.

BRIEF DESCRIPTION OF THE FIGURES

The invention will now be described, by way of illustration only with reference to the accompanying drawings which show in FIGS. 1 and 2 fragmentary elevations illustrating the closures in accordance with the present invention prior to, and on application.

DETAILED DESCRIPTION

Figure 1:
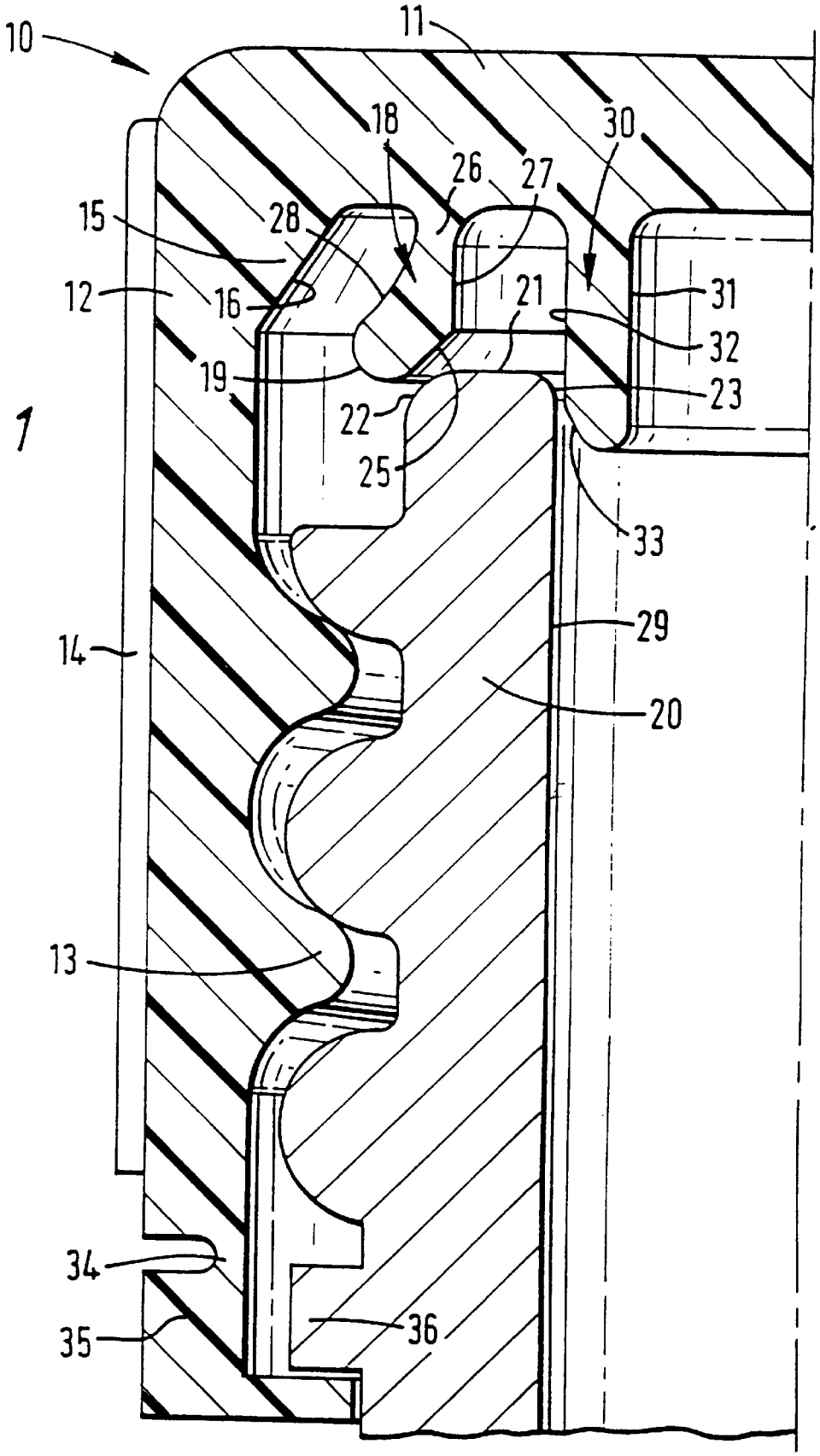

The closure 10 is molded in one piece from a resilient plastic material and has a top (crown) 11 and a dependent skirt 12 formed with an internal screw thread 13 and external knurling 14. A corner region 15 at the upper end of the skirt is thickened and has a conically flared internal surface 16 extending at an angle of about 30° from the axis of the closure 10. Spaced radially inwardly of the surface 16 is a resilient bulbous fin 18 which extends from an articulation point 26 on the under side of the top 11. The bulbous fin 18 thus depends downwardly from the articulation point 26. The radially inner surface 27 extends generally parallel to the plane of the skirt 12 whereas the radially outer portion 28 of the bulbous fin is curved generally radially outwardly and downwardly to define at its remote end an outer sealing portion 19. The outer sealing portion is conjoined to the inner radially inner surface 27 by means of an inclined plane 25 having an angle of about 45°.

Closures of this type may be produced, preferably by injection molding, with or without a tamper evident band. Preferably the skirt terminates in a plurality of frangible bridges 34 supporting a tamper evident band 35 for cooperation with a plain security band 36 on the outer neck portion of a container neck 20 in the usual way.

Figure 2:
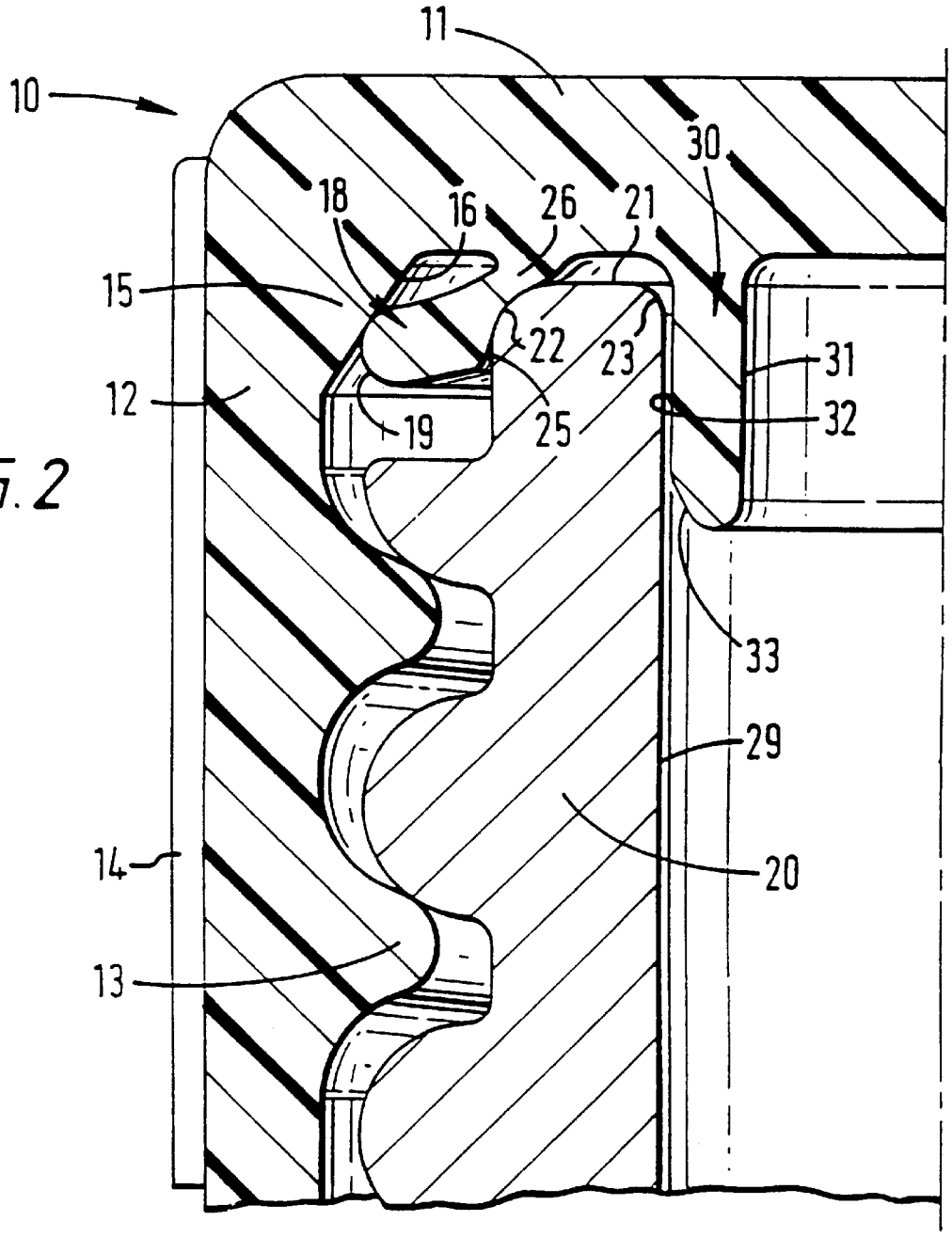

In use, the container closure 10 is applied to a neck 20 of a container so that the rim 21 of the container neck moves upwardly as in FIG. 1 to adopt the position shown in FIG. 2. As it does so, the inclined plane 25 of the bulbous fin 18 comes into contact with the outer rim portion 22 of the container neck 20 while the closure 10 is being rotated during the capping operation. This has the subsequent effect of assisting in a centering action such that the axis of the container closure and the container neck become coaxial with more certainty. Further rotation of the container closure 10 relative to the container neck 20 causes the container neck to move upwardly relative to the container closure to adopt the position shown in FIG. 2. It will be noted that the articulation of point 26 is disposed approximately one third of the radial distance between the inner and outer surface of the container neck such that the bulbous fin 18 is deformed radially outwardly to seal between the inclined surface 25 and conically flared internal surface 16. At the same time, because of this radial displacement, there is a pivotal force applied to the internal surface of the crown closure which tends to resist doming in conjunction with the locator annulus 30 referred to below.

Arrangements of the foregoing type are used with the main feature of the invention shown in FIGS. 1 and 2, i.e. the locator annulus 30. Disposed radially inwardly of the bulbous fin 18, the locator annulus 30 has an external diameter 32 which is just smaller than the inner diameter of the internal surface 29 of the container neck. The locator annulus 30 is provided therefore with a radially inner face 31, a radially outer face 32, the radially outer face 32 culminating towards its remote end in an annular inclined plane 33 which extends upwardly and outwardly towards the inner face of the container neck 29.

In use during the capping procedure, the inner rim portion 23 which is radiused comes into contact with the inclined plane of the locator annulus 30 which has the effect of centering the container closure on the container neck. As the cap is rotated, there is relative movement between the container neck 20 and the closure 10 such that it adopts the position shown in FIG. 2. Because the locator annulus is not intended as a seal but essentially and primarily as a locator means, the sealing effect is to be found between the outer rim portion 22 and the bulbous fin 18. The effect of this is that because the closure 10 is correctly orientated relative to the container neck 20 the problems of "cocking" and centering are correctly addressed.

Further and probably as importantly, because the locator annulus is disposed inward of the bulbous fin, it tends to strengthen the central portions of the crown 11. This resists doming.

The locator annulus 30 has the further effect of retaining the closure coaxially upon the container neck thus resisting tampering.

It will thus be seen that during application of the closure 10 to the container neck 20, the rim of the container 21 first comes into contact with the inclined surface 33 of the locator annulus 30 prior to any contact of the bulbous fin 18. This tends to center and directly orientate the closure relative to the container neck. Subsequently the outer rim portion 22 of the container neck 20 comes into contact with the inclined plane 25 which has a further centering and anti-cocking action as a primary factor with the secondary effect of causing the bulbous fin 18 to articulate at the point 26 as such that the surface 28 comes into contact with the conically flared internal surface 16 thereby causing effective sealing.

It will also be appreciated that by virtue of the relative thickness of the bulbous fin 18 taken with the effects of the locator annulus, a more effective seal is provided than previously. The locator annulus also tends to absorb all lateral forces of application generated by the combination of the application of force and the helical angle of the container/closure threads. This ensures that none of these forces impinge upon the bulbous fin 18 such that the same is inconsistently engaged with the container.

The locator annulus and the stiffness of the closure crown together have the effect that any doming of the crown under pressure will only take place within the circumference of the locator annulus 30. This has two effects. In the first place it reduces the effects of doming upon the bulbous fin 18 thus ensuring that the fin does not get pulled out of sealing engagement with the container during cases of extreme doming. Further the locator ring acts as a stiffening rib which resists and reduces the degree of doming exerted by the internal force. This tends to reduce storage problems when the containers are stacked.

This invention is particularly desirable when applying a closure to returnable containers where there is a risk of possible damage to the outside corner/surface of the container which might provide a leakage path past the bulbous fin seal in high temperature storage conditions where doming can be expected.

The inventive closures are preferably made by injection molding of high density polyethylene plastic materials. The locator annulus is intended to have no sealing properties and hence needs to be used in conjunction with a primary seal for example as hereinbefore set forth.

The invention provides therefore a closure as hereinbefore set forth and an assembly thereof with container closure.

What is claimed is:

1. A unitary closure molded from a plastic material for closing and sealing an opening in a neck of a container, comprising (a) a crown;

(b) a skirt depending from an outer portion of said crown, said skirt including a screw thread on a radially inner surface thereof;

(c) an inner flared surface extending downwardly and outwardly from said crown to said skirt;

(d) an annular resilient fin extending downwardly and outwardly from an articulation position on an underside of said crown at a position spaced radially inwardly from said flared surface and having a length slightly greater than the spacing from said flared surface, said fin having a bulbous lower end and being deformed outwardly by the top of the neck of the container when said closure is screwed onto the neck, the bulbous lower end of said fin being pressed into engagement with said flared surface when said closure is screwed onto the neck; and (e) a locator annulus arranged radially inwardly of said fin and extending downwardly from the underside of said crown to a distance beyond the extension of said fin, said locator annulus partially engaging an inner surface of the container neck while the closure is screwed onto the container neck but without sealing with the container neck when the closure is screwed thereon.

2. A closure as defined in claim 1, wherein said fin includes a rim contact surface inclined inwardly and upwardly toward said crown for contact with an outer rim of the container neck, and further wherein said fin articulation position is located between an inner rim and the outer rim of the container neck with the position being closer to the outer rim.

3. A container closure as defined in claim 2, wherein said articulation position is located within the outer one third radial distance between the inner and outer rims of the container neck.

4. A closure as defined in claim 2, wherein said rim contact surface of said fin is at an angle to the axis of the closure of 35° to 55°.

5. A closure as defined in claim 2, wherein the distance between the underside of said crown and a remote end of said locator annulus is up to twice as long as the distance between the underside of the crown and a remote tip of said fin.

6. A closure as defined in claim a 5, wherein the remote end of said locator annulus terminates in an outwardly and upwardly inclined portion to present an outwardly and upwardly inclined surface to the inner rim of the container neck during capping.

7. A closure as defined in claim 6, wherein an upper end of the inclined portion of said locator annulus terminates adjacent to a plane horizontal to the axis of the closure, which plane is at least coincident with the remote tip of said bulbous fin.

8. A closure as defined in claim 7, wherein the inclined portion of said locator annulus and the rim contact surface of said bulbous fin operate sequentially on opposite sides of the rim while the closure is screwed onto the container neck.

9. A closure as defined in claim 6, wherein a closure angle of the inclined surface of said locator annulus is 25° to 35° relative to the axis of the closure.

10. A closure as defined in claim 1, wherein said skirt terminates in a plurality of frangible bridges supporting a tamper evident band adapted for cooperation with a security band on an outer neck portion of the container.

* * * * *